United States Patent [19]

Smith et al.

[11] 3,931,918

[45] Jan. 13, 1976

[54] CONVERTIBLE PACK FRAME WITH COMPRESSOR FLAPS FOR SUPPORTING A TENT IN DIFFERENT MODES

[76] Inventors: George N. Smith, Deerhaven Road, Bedminister, N.J. 07921; John J. Marshall, 5 W. Riding Drive, Bel Air, Md. 21014

[22] Filed: Feb. 2, 1972

[21] Appl. No.: 222,918

[52] U.S. Cl. ..... 224/10; 224/25 A

[51] Int. Cl.[2] ..... A45F 4/04

[58] Field of Search..... 224/25 A, 9, 10, 8 R, 29 R, 224/30 R, 31, 32 R, 39 R, 42.43, 42.45 R; 135/1 R, 5 R; 280/150 R

[56] References Cited

UNITED STATES PATENTS

| | | | |
|---|---|---|---|
| 1,158,356 | 10/1915 | Wilson | 135/1 R |
| 2,197,427 | 4/1940 | Despain | 224/25 A |
| 3,757,360 | 9/1973 | Wescott | 135/1 R |

FOREIGN PATENTS OR APPLICATIONS

| | | | |
|---|---|---|---|
| 216,857 | 12/1924 | United Kingdom | 224/10 |

*Primary Examiner*—Robert J. Spar
*Assistant Examiner*—Jerold M. Forsberg

[57] ABSTRACT

In a preferred embodiment, a back-pack frame having a tent attached when mounted on the frame, in a manner whereby the tent substantially encloses several containers for clothes, food, and the like, and opposing flaps mounted on opposite upright frame supports extend laterally around the folded tent such as to substantially circumscribe the back-pack tent and when the opposing flaps are attached together at their leading edges, they are attachable in a manner which compresses and firms-up the back-pack, tent, and the enclosed containers, the individual flap carrying a plurality of accessory-attaching pockets each respectively customshaped to fit a particular accessory for which it is intended, and the back-pack frame serving as a support for one end of the tent in an erected state as well as the frame including other support elements transportable as a part of or as contained within the back-pack frame for supporting the erected tent at other positions such as an opposite tent end, the novel combination also including a detachable grill which when attached to the frame serves as a further support for supporting the folded tent pack when packed for back-packing.

20 Claims, 11 Drawing Figures

CONVERTIBLE PACK FRAME WITH COMPRESSOR FLAPS FOR SUPPORTING A TENT IN DIFFERENT MODES

This invention relates to a back-pack tent combination for utilization in hunting, fishing, mountain climbing, canoeing, and the like.

BACKGROUND

Prior to this invention, there has not existed any back-pack of light weight suitable for utilization of various elements and parts thereof for multiple purposes while concurrently being of a practical small and light-weight size together with being adaptable to a variety of different particular sports such as hunting, or alternatively fishing, or alternatively mountain climbing, or alternatively canoeing, and the like, as well as none of the prior art packs being adaptable for speedy erection of the compacted tent as well as the speedy lowering and packing-up of the tent being possible together with the lack or inability of the camper or back-packer to have ready access to any one or more of the containers and contents thereof, and as well as the prior back packs not having, together with the other lack of advantages, ready accessibility to any one or more particular accessories that might be needed from time to time during the back-packing for any particular sport.

Typical of prior art patents directed to tents of the type capable of being carried on the back of a back-packer, include for example, U.S. Pat. No. 650,554 to Conley directed to a tent-knap-sack combination in which the tent is convertible to a hammock; U.S. Pat. No. 2,792,844 of Clark directed to a collapsible tent-back-pack combination where the tent is of relatively of small size and for the carrying of a substantially small quantity of various goods; U.S. Pat. No. 1,198,778 to Robinson similarly directed to a collapsible tent and knap-sack combination and including a couple of pockets for utilization as the knap-sack portion for carrying a very small quantity of goods as might be desired; and the U.S. Pat. No. 510,239 to Carr directed to a tent-bed-knapsack combination. Characteristic of back-pack frames and flaps of various designs are patents such as U.S. Pat. No. 2,836,334 to Davis, U.S. Pat. No. 3,368,725 to Martin, U.S. Pat. No. 3,563,431 to Pletz, U.S. Pat. No. 3,367,547 to Albert et al., and U.S. Pat. No. 3,219,243 to Mack.

SUMMARY OF THE INVENTION

An object of this invention is to overcome deficiencies of knapsacks, back-packs, tent-packs, of the type discussed above, together with obtaining novel advantages not heretofore available.

Another object is to reduce the overall bulkiness of a tent-back-pack.

Another object is to improve compactness of a tent back-pack.

Another object is a tent back-pack having multi-use elements.

Another object is a tent back-pack combination easily transportable on the back of a human being.

Another object is a collapsible back-pack tent combination in which the tent is capable of being speedily erected, and/or speedily taken-down.

Another object is a back-pack tent secureable to a back-pack frame, such as to be protective of container(s) a part of the back-pack.

Another object is a back-pack tent foldable and secureable such that one or more containers a part of the combination are readily accessible during backpacking, without the necessity of unpacking substantially an entire back-pack.

Another object is a back-pack tent utilizable of a back-pack frame as a tent support for support thereof.

Another object is a back-pack frame carrying tent-support elements.

Another object is a back-pack adaptable to multi-purpose utility such as various sports.

Another object is a back-pack adapted to conserve on space and/or to increase in the number of accessories transportable conveniently.

Another object is an improved tent flap adaptable to various conditions — or frame flap, as the case may be.

Another object is a tent of back-pack nature having a built-in water-resistent tent bottom(base).

Another object is a foldable tent having as a part thereof a suitable bed-pad.

Another objects become apparent from the preceding and following disclosure.

One or more objects described above are obtained by the invention as defined hereafter.

The invention herein is not so much the invention of any new element, but the invention rather resides in a novel combinations of improved utility and overall unity of function, with various elements serving multiple purposes whereby the back-pack unit of this invention is adaptable to a much greater extent than heretofore possible to varied conditions and sports. In particular, for example, the invention includes a novel combination including various pack container bags or units either separate or as compartments of a multicompartmented container unit, together with a collapsible portable tent, together with one or more flaps adapted to substantially encompass the folded collapsed tent which in turn preferably encompasses the container means (units), with the compressor means compressible of the overall unit, with a harness attached thereto for mounting the combination as a whole on any suitable carrier such as a motorcycle, a conoe, a horse or donkey, a human being for carrying on the back of a man or woman, or the like. In preferred embodiments of this basic combination, there are included other elements such as a back-pack frame, the back-pack frame itself being utilizable as a support element for the tent as well as preferably carrying in telescoped or within hollow tubular compartments other tent-erection support elements, with the folded tent secureable to and normally secured to, in the folded condition, the back-pack frame with the folded tent preferably partially encompassing and circumscribing and/or shielding the container bags in a manner such that at least one openable end of one or more of the container bags is accessible by the opening of the flap-compressor, and preferably with the flap compressor including accessory-container compartments thereon tailor-designed to fit particular predetermined accessories such as various fishing gear and/or hooks, or such as various types of guns, bullets, and/or shells, and the like, and such as mountain climbing or the like. Also, such a flap compressor preferably is detachable and conveniently attachable to a person such as by a loop receiveable of the head and neck of a person and/or appropriate tie-strings for tying around the neck or the waist, or the like.

THE FIGURES

Figure 4:
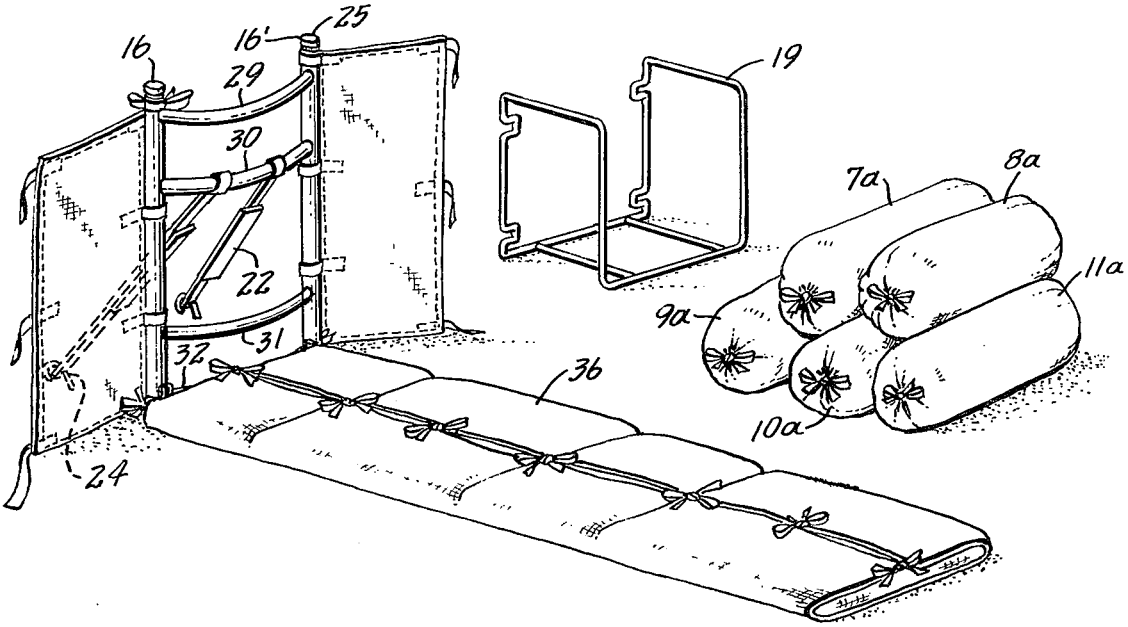
Figure 5:
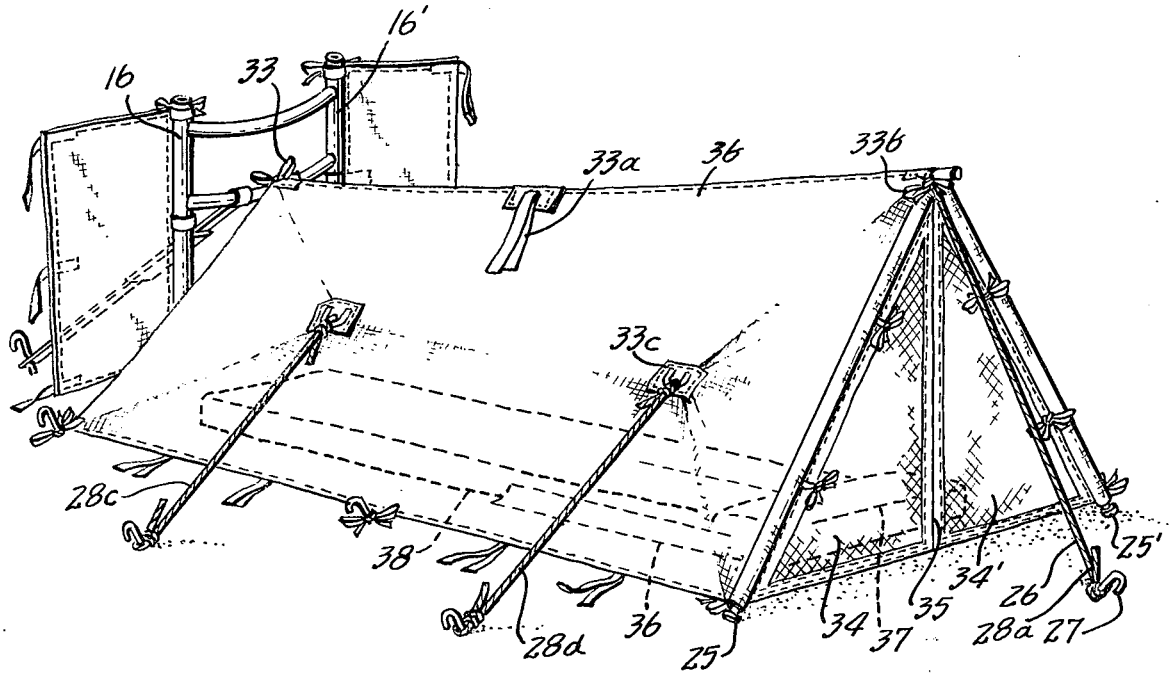

In side perspective views, FIG. 5 illustrates the appearance of the embodiment illustrated in FIG. 4, after erection of the tent and tying of the tent apex to an upper bar of the pack frame acting as a tent support at one end of the tent and with the tent supports formerly encased within the frame being mounted within the opposite end of the tent, as tent supports.

Figure 6:
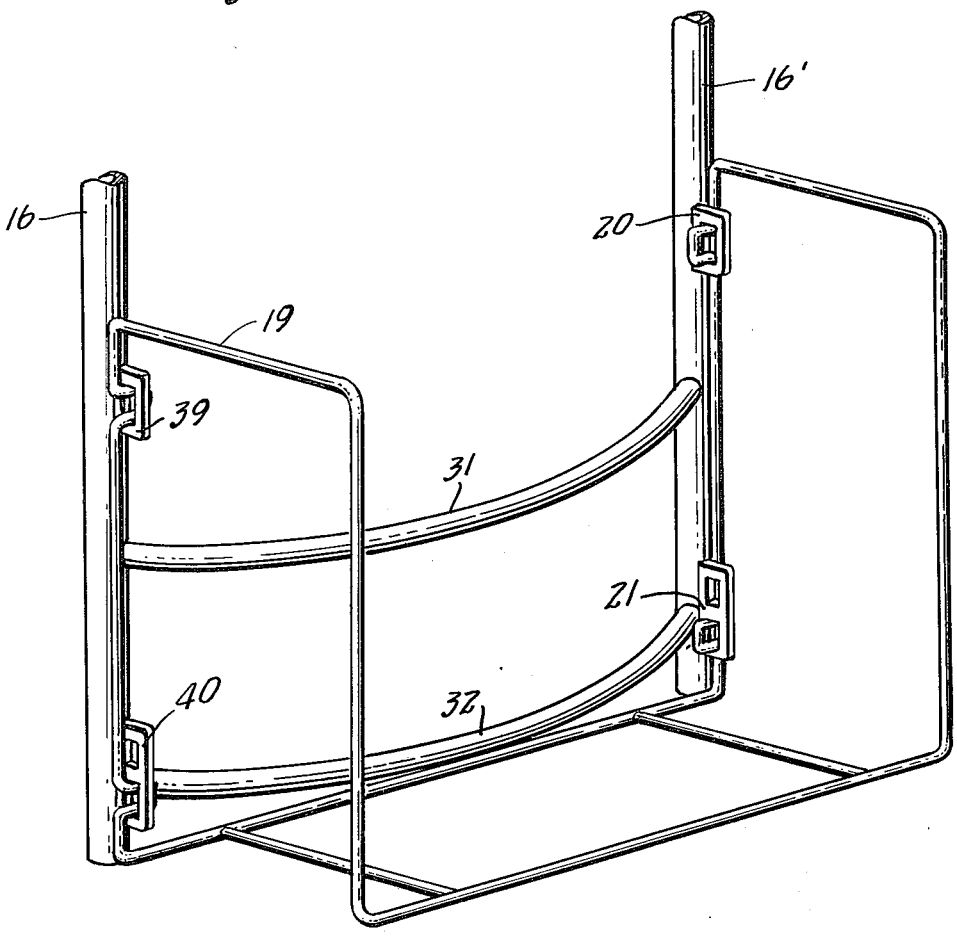

FIG. 6 illustrates an in-part view of the lower portion of a back pack frame having mounted thereon the horizontal base back pack support illustrated above in FIGS. 4 and 5.

Figure 7:
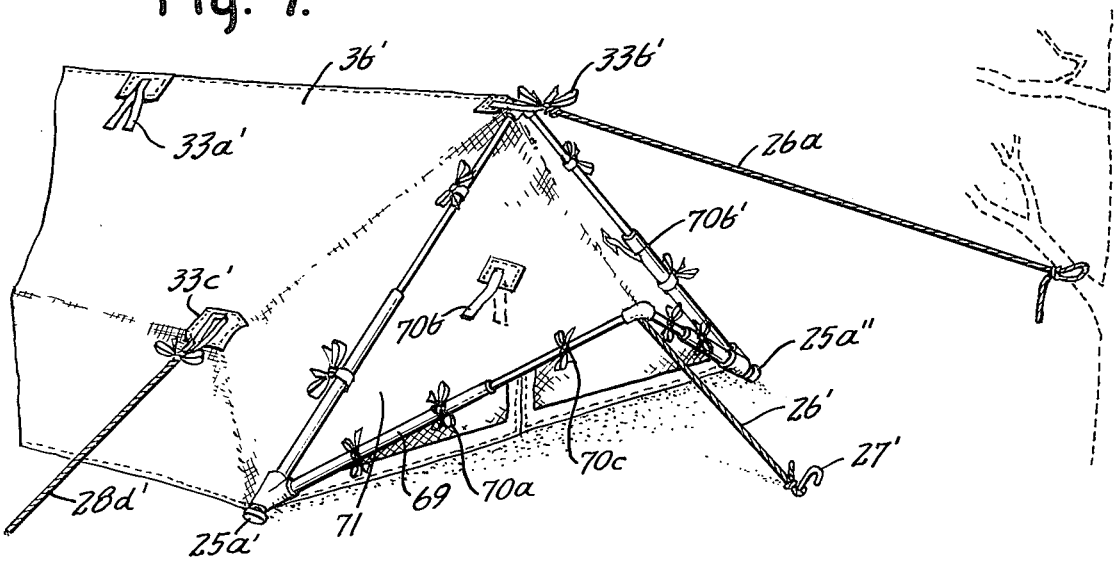

FIG. 7 illustrates a perspective front view of a backpack having telescopable upright supports with an awinging fabric in a partially raised position.

Figure 3:
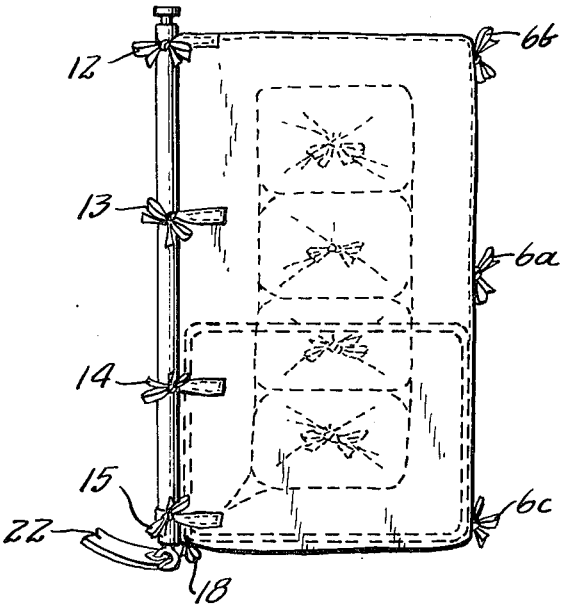
FIG. 3 illustrates a side view of the embodiment of FIG. 2 after the tent has been unrolled and the several packs and the horizontal support removed and laid-out beside the tent in a still partially folded tent-state, and the vertical frame supported at one end by the harness straps.
Figure 8:
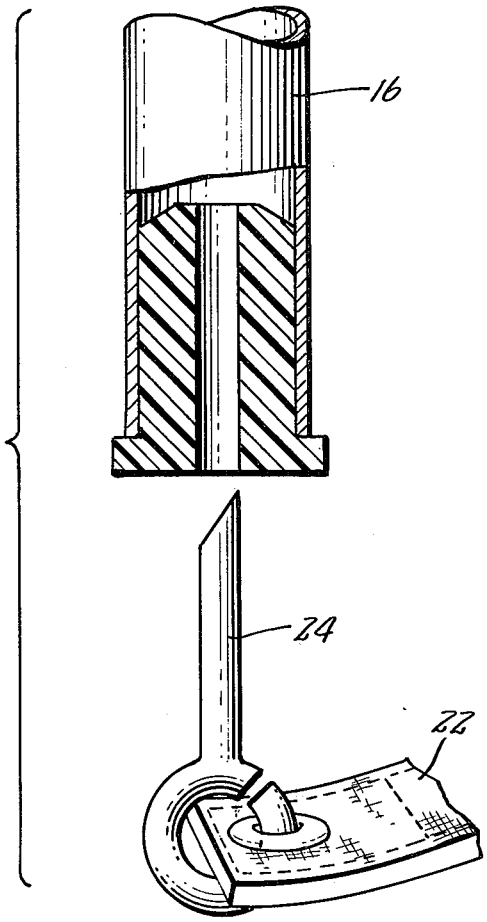

FIG. 8 illustrates a preferred embodiment in which a peg is inserted upwardly into each vertical support of an embodiment such as that of FIG. 3, with the lower end of the harness attached thereto, with the peg illustrated in non-inserted exploded view, and being supportable of the tent end frame in a manner such as illustrated in each of FIGS. 4 and 5.

Figure 9:
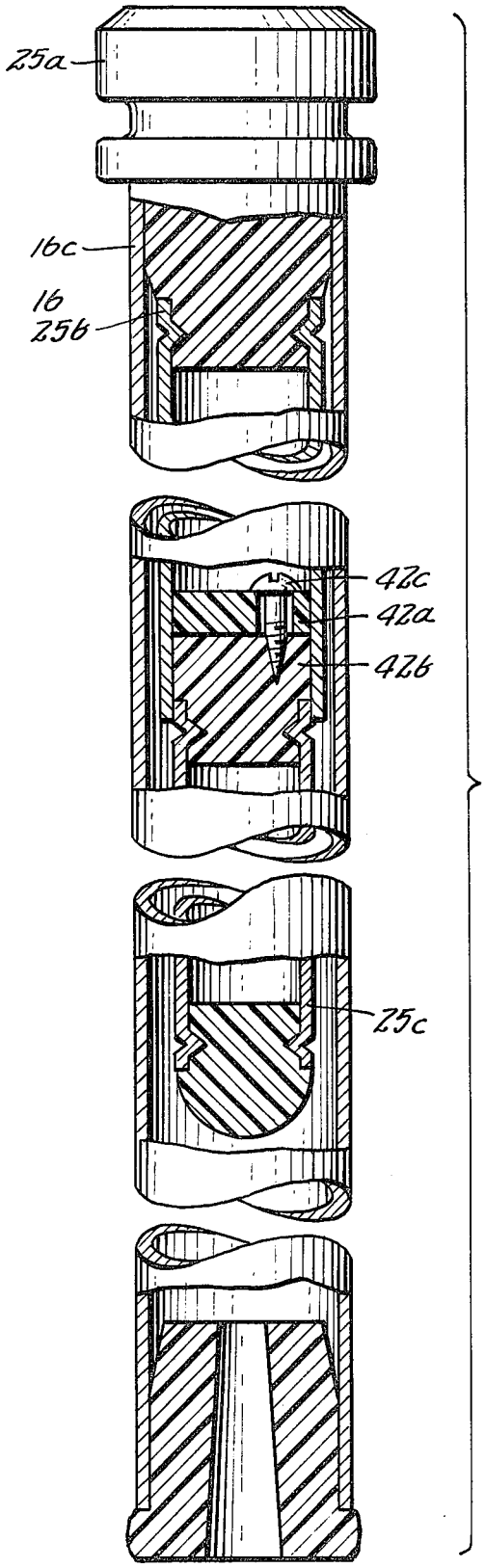

FIG. 9 illustrates an in-part enlarged view of one of the uprights of an embodiment such as that of FIG. 3, the FIG. 6A being a side view in cross-section.

Figure 10:
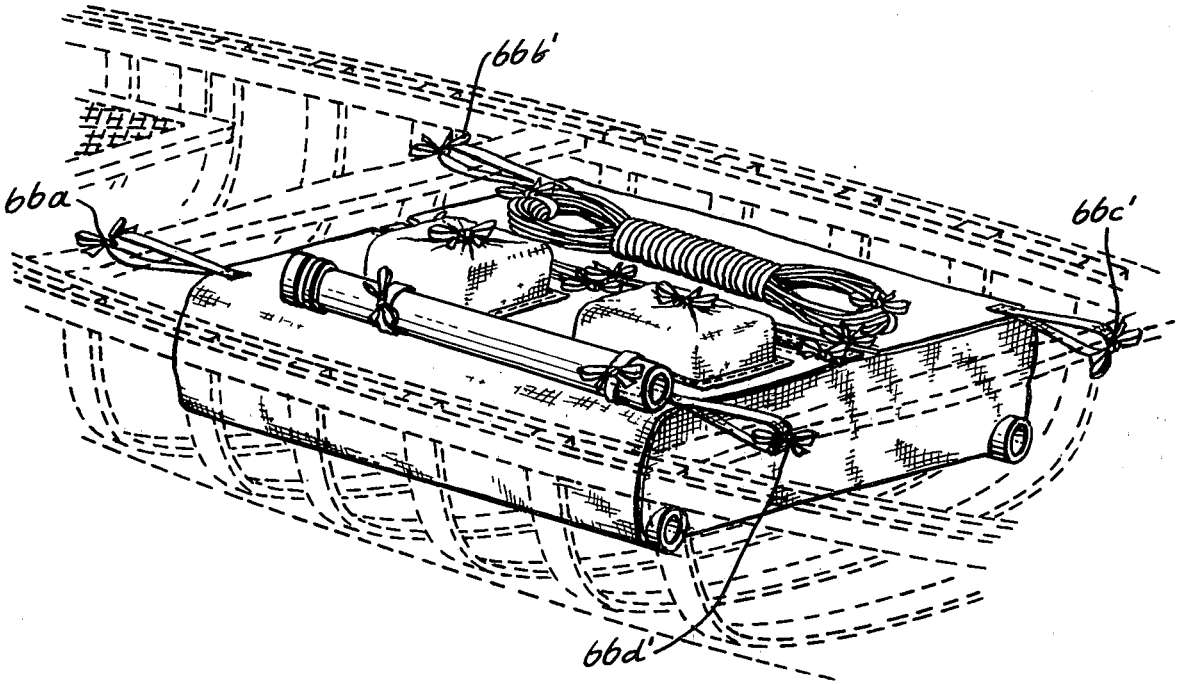

FIG. 10 illustrates in perspective side view a canoe-trip camper in phantom with a typical pack therefor.

Figure 11:
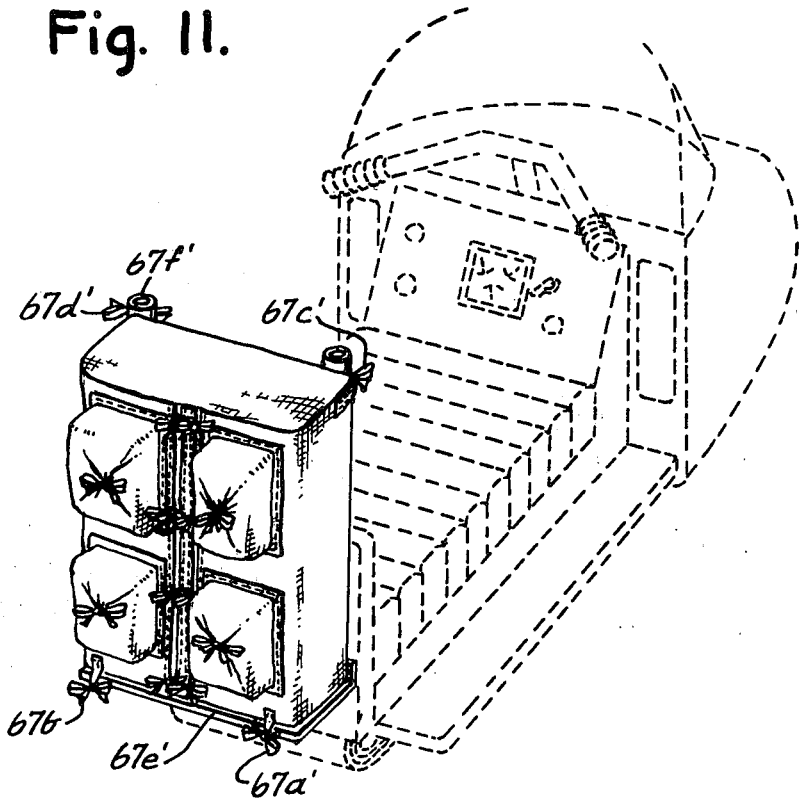

FIG. 11 illustrates in side perspective view a skimobile camper in phantom with a typical pack therefor.

DETAILED DESCRIPTION OF THE INVENTION

Figure 1:
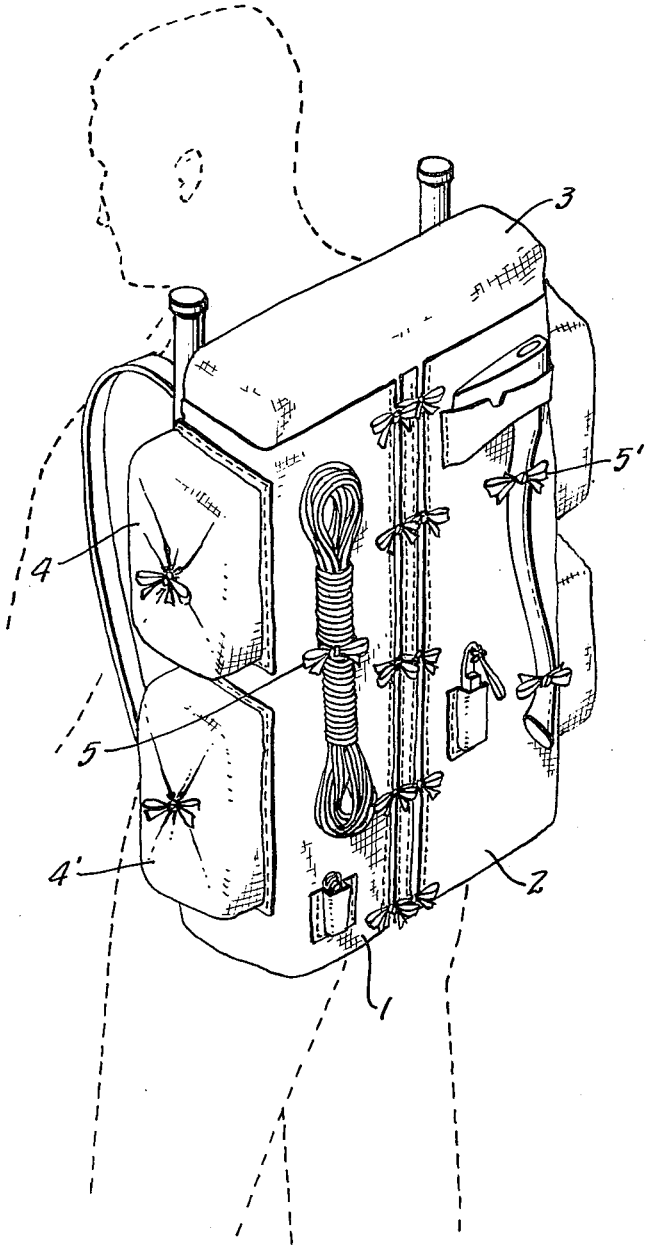
FIG. 1 illustrates a perspective view of a general camper including exterior pocket containers on the compressor flaps transportable of miscellaneous accessories.

Referring now to the figures in greater detail, FIG. 1 illustrates a typical back pack and frame of this invention including opposing compressor flaps 1 and 2 wrapped laterally around a folded tent 3, additionally illustrating the accessory attaching means such as draw-string pockets 4 and 4′ designed specifically to fit predetermined accessories, as well as attachments 5 and 5′ for carrying line (rope) and axe.

Figure 2:
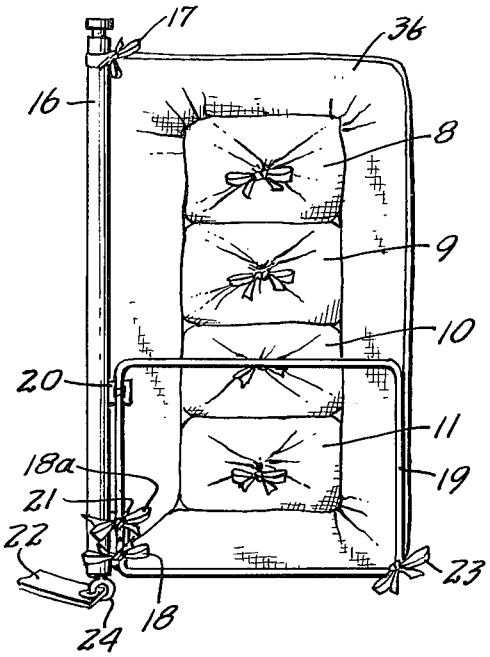
FIG. 2 illustrates a side view of a camper with the flaps detached and removed therefrom illustrating the typical appearance of the several packs circumscribed by the folded tent with the folded tent mounted on the frame and with the accessory horizontal support snapped under the pack position onto the frame.

FIG. 2 typically illustrates a side view of a camper of the type illustrated typically in FIG. 1, but with a side flap shown in an open position as flap 1B opened whereby mounted accessories are viewable on the inside of the flap and whereby a side view of the folded tent 3b is viewable as well as the drawstring storage packs or bags 8, 9, 10, and 11, these storage bags having their open ends accessible without dismounting the entire pack by merely opening the flap 1b as is illustrated. Also this view of FIG. 2 illustrates mounting straps 12, 13, 14 and 15, attaching the flap 1b to the frame post 16, as well as the straps 17 and 18 in-part attaching the tent 3b to the post 16. Also illustrated is the lower detachable frame-grill member 19 attach suitably at typical points 20 and 21 to the frame post 16. Also partially hidden from view by the flap 1b is the strap 22. The tent pack 3b also is tied to the detachable frame 19 typically straps such as by strap 23. FIG. 3 illustrates the embodiment of FIG. 2 with the flap 1*b* closed and tied by a bow-string such as bow-string 6*a*.

FIG. 4 illustrates a perspective view of the embodiment of FIG. 1 when the folded tent is unrolled onto a horizontal surface such as the ground, with the frame post 16 together with the remainder of the frame held in an upright position by strap 22 with the insertable pegs staked into the ground. The telescoped stored tent support 25 in the hollow post 16 is still shown inserted. Compressor flaps are still mounted, with a loose tie string 24. Dismounted support 19 and stacked storage sacks 7*a*, 8*a*, 9*a*, 10*a*, and 11*a*, are also illustrated.

FIG. 5 illustrates the same embodiment as that of FIG. 4 except with the tent in the unfolded and raised (erected) position, in particular additionally illustrating the tent-bar frame support 25 inserted into the distal end of the tent acting as a tent erection support, as well as line 26 extending from the top of the tent as secured by a peg 27 by line end 28*a*. Although side lines 28*c*, 28*d*, 28*e*, and the like help to hold the tent 3*b* in a taught position and state of being, the top of the tent at the back pack frame end is attached by bow-strings 33. This figure additionally illustrates the netting 34 and 34′ for holding the respective netting flaps together in a closed state when desired, and viewable inside of the tent is a pillow case 37 fixedly attached to a tent mat 36, the pillow case 36 preferably having an open or openable end to receive removed clothing of the camper to serve as the pillow stuffing. Also viewable is the also-attached slepping bag 38, which is a part of the tent bottom.

FIG. 6 illustrates the support-grill 19 and the mated male and female members such as 20 and 39 respectively and 21 and 40 respectively. It should be noted in FIG. 6 that the crossbars such as crossbars 31 and 32 typically are arced to fit the back of a human being on which the frame is mountable, the frame of FIG. 6 being viewed as a back side thereof.

FIG. 7 illustrates a perspective front view of an embodiment utilizing telescopable upright supports, having telescopable structure shown in the attached (united) state forming a V-shaped awining-type structure having mounted thereon the awning fabric 71. FIG. 7 for example illustrates the tied tie-strings 70*a* and 70*c* securing the awning structure 69 at a chosen level such as in a partially raised position.

FIG. 8 illustrates an in-part and cross-sectional view of typically pole 16 lower portion shaped to receive male peg (tent-peg) such as illustrated in FIG. 2, the peg loop having mounted thereon the harness strap 22 having a second utility as a tent support line or strap, by supporting the frame 16 in an upright position.

FIG. 9 illustrates an in-part view of a typical frame support 16*c* having a typical tent support insert 25*a* composed of member 25*b* (upper) and a telescoped lower member 25*c* with a locking means 42 composed of separate disks 42*a* and 42*b* and eccentrically mounted screw 42*c*.

FIG. 10 illustrates a general camper but adapted for canoe use, including end tie-downs 66*a*′ and 66*b*′, 66*c*′ and 66*d*; for security to prevent loss of the pack if the boat or canoe overturns.

FIG. 11 illustrates in rear perspective view a mounting in a position by a support by tie-downs 67*a'* through 67*f'*, of a pack as it would be adaptable to a snowmobile.

Variations and equivalents of ordinary skill are included within this invention for all embodiments illustrated, described, and/or claimed hereafter.

We claim:

1. A pack comprising in combination: container means for retaining articles during transport thereof by harness attachment during enclosure in association with a folded tent by a compressor; a collapsible portable tent means for intermittent attachment in a folded state in association with the container means during compressor enclosure, by a harness attachment; flap compressor means for intermittent at-least partially enclosing and releasably securing together said container means and said tent means by harness attachment during transport thereof while enclosed by a compressor thereof; harness means for attachably harnessing together and during a harnessed state transporting said container means, said tent means in a collapsed folded state, and said compressor means in a state of enclosing the container means and the tent means; and a pack frame means for mounting of the harness means during said transporting, said pack frame means including transportable and harness-frame-attachable substantially rigid support elements anchoring securably the harness means during said transporting, the pack frame means including as a part of said support elements structure such that the support elements are coordinated one with the other in association with and mounted in the tent means in an unfolded state to result in a rigid tent-erection support holding the tent in an erected raised state.

2. The pack according to claim 1, in which said container means comprises separate elongated bags having a closeable opening at at-least one end of each bag; in which said tent means includes a tent foldable around said bags such that each bag's said one-end opening remains accessible; and in which said compressor is over-lapable of said one-end opening of all of said bags.

3. The pack according to claim 1, in which said compressor means includes accessory-attaching means for a transporting of accessories.

4. The pack according to claim 1, in which said compressor means includes two opposing flaps and in which said tent is secureable to said frame means when said tent is in a folded state, said tent when folded at least partially enveloping said container means.

5. The pack according to claim 4, in which said compressor means includes accessory-attaching means for a transporting of accessories.

6. The pack according to claim 1, in which said tent means comprises tubular-shaped tent fabric and a bed-pad means extending longitudinally along one inner side of the tubular-shaped fabric.

7. The pack according to claim 6, including openable and secureably-closeable netting and openableable and secureablycloseable weather-resistant closure means for closing-off the tent's end opening, at each openable end of said tubularshaped tent fabric.

8. The pack according to claim 7, including a pack frame means which includes transportable and harness-frame-attachable support elements for said transporting and for attaching of said harness means to said frame means, said frame means support elements being rigid and utilizable in holding said tent means in an erected state, said tent means being receiveable of said elements, said container means comprising separate elongated bags and a closeable opening at at-least one end of each bag, said tent means including a foldable tent which when folded at least partially envelops said container means such that each bag's said at-least one-end opening remains accessible, said compressor means when in a compressing state being over-laping of said one-end opening of substantially all of said bags, said compressor means including two opposing flaps, being secureable to said frame means, and carrying accessory-attaching means for a transporting of accessories.

9. The pack according to claim 8, in which at least one end-closure means includes a retractable awning means.

10. The pack according to claim 1, in which said tent means comprises tubular-shaped tent fabric and a bed-pad means extending longitudinally along one inner side of the tubular-shaped fabric with an outerside of the tubular fabric about opposite to said bed-pad means being of a sturdier water-resistant composition than other portions of said fabric, openable and secureably-closeable weather-resistant closure means being included at each openable end of said tubular-shaped tent fabric, and a retractable awning means being included at at-least one end-closure means.

11. The pack according to claim 1, including an accessory-attaching flap means comprising a plurality of closeable pocket fabric containers each shaped to conform to a particular accessory's shape and said plurality being shaped each respectively to receive accessories utilizable commonly for a particular sport.

12. The pack according to claim 1, in which said compressor-means includes accessory-attaching flap means for transporting of accessories, said flap means comprising a plurality of closeable pocket fabric containers each shaped to conform to a particular accessory's shape and said plurality being shaped each respectively to receive accessories utilizable commonly for a particular sport.

13. The pack according to claim 1, in which said tent means includes tent-extension fabric drapable over and substantially encloseable of a motorcycle.

14. The pack according to claim 13, said pack frame means including a motorcycle with retractable stand means for parking in a substantially upright state and a tent-erection support means utilizable in holding said tent means in an erected state and said tent-erection support means including a support element collapsably mounted on said motorcycle.

15. The pack according to claim 1, in which said frame means includes at least one element attachable to a motorcycle such that said frame means is mountable on a motorcycle aft section.

16. The pack according to claim 1, in which said frame means includes at least one element attachable to a canoe interior.

17. The pack according to claim 1, in which said frame means includes at least one element attachable to a snowmobile.

18. A pack comprising in combination: a collapsible portable tent means for, when in a folded state, intermittent attachment by a harness attachment to a support frame structure; harness means for attachably harnessing together and during a harnessed state transporting said collapsible portable tent means in a folded state and other items; a human-being back pack frame means for mounting of the harness means during said transporting and for concurrently mounting onto a person's back the harness means, and for mounting thereon said tent means in a collapsed portable state, the pack frame means including substantially rigid tent-erection support elements holding said tent means in an erected state, the tent means being receivable of said elements; pack-container means for retaining articles during transport thereof by said harness means and said pack means together with said tent means in a collapsed and harnessed state as compressed by a compressor, said pack-container means comprising separate elongated bags having a closable opening at at-least one end of each bag; a tent-peg element attached to said pack frame means; a detachable lower frame element mountable on a lower portion of said pack frame means and when mounted extending rearwardly forming a substantially horizontal support for said tent means when folded and mounted on said frame means, the lower frame element being detachable and when detached being utilizable as a grill; flap-compressor means at least partially enclosable of and releasably-securable of said container means and said tent means and being over-lapable of said one-end opening of all of said bags, and having accessory-attaching means for transporting of accessories, and being two flaps mounted in opposing relationship to one-another as mounted on said frame means; the support elements including at least one male element and one female element lockable one into the other, the male element being storable within the female element, said harness means including a shoulder harness, said tent means including a tent folded around said bags such that each bag's said at-least one-end opening remains accessible, said tent being secured to said frame means when said tent is in either folded or unfolded erected states, said tent in an erected state extending rearwardly from said frame as a substantially tubular-shaped tent fabric; bed-pad means extending longitudinally along one inner side of the tubular-shaped fabric; and openable securably-closable netting and openable securably-closable weather-resistant closure means at each openable end of said tubular-shaped tent fabric.

19. The pack according to claim 18, in which at least one end-closure means includes a retractable awning means, and said frame including two upright about parallel tubes and four transverse about horizontal tubes extending between and connecting said parallel tubes.

20. The pack according to claim 19, in which said accessoryattaching means comprises a plurality of closeable pocket fabric containers each shaped to conform to a particular accessory's shape, and said plurality being shaped each respectively to receive accessories utilizable commonly for a particular sport.

* * * * *